US005218942A

United States Patent [19]

Coha et al.

[11] Patent Number: 5,218,942

[45] Date of Patent: Jun. 15, 1993

[54] MODULAR FUEL SENDER FOR MOTOR VEHICLE

[75] Inventors: Timothy F. Coha, Burton; Ulf Sawert, Grand Blanc; Neal M. Letendre, Grand Blanc; William S. Zimmerman, Grand Blanc; Gregory K. Rasmussen, Grand Blanc; Leon Pitek, Flint; Dan H. Emmert, Grand Blanc, all of Mich.

[73] Assignee: General Motors Corporation, Detroit, Mich.

[21] Appl. No.: 983,339

[22] Filed: Nov. 30, 1992

[51] Int. Cl.[5] ..... F02M 33/00

[52] U.S. Cl. ..... 123/514; 123/509; 417/428; 137/576; 137/578

[58] Field of Search ..... 123/514, 516, 509, 510; 417/279, 428, 360; 137/571, 574, 576, 565, 577, 578, 398, 399

[56] References Cited

U.S. PATENT DOCUMENTS

| | | | |
|---|---|---|---|
| 3,315,880 | 10/1965 | Kropiwnicki | 417/428 |
| 4,503,885 | 3/1985 | Hall | 137/576 |
| 4,747,388 | 5/1988 | Tuckey | 123/514 |
| 4,780,063 | 10/1988 | Tuckey | 137/565 |
| 4,869,225 | 9/1989 | Nagata | 123/514 |
| 4,893,647 | 1/1990 | Tuckey | 123/514 |
| 4,928,657 | 5/1990 | Asselin | 123/514 |
| 4,974,570 | 12/1990 | Szwargolski | 123/514 |
| 5,050,567 | 9/1991 | Suzuki | 123/514 |
| 5,070,849 | 12/1991 | Rich et al. | 123/509 |
| 5,080,077 | 1/1992 | Sawert | 123/514 |
| 5,110,265 | 5/1992 | Kato et al. | 417/279 |
| 5,111,844 | 5/1992 | Emmert | 123/514 |
| 5,139,000 | 8/1992 | Sawert | 123/514 |

*Primary Examiner*—Carl S. Miller
*Attorney, Agent, or Firm*—Saul Schwartz

[57] ABSTRACT

A modular fuel sender in a fuel tank of a motor vehicle includes a reservoir, a fuel pump in the reservoir, a low pressure conduit conducting hot return fuel back to the reservoir, a secondary pump in the reservoir for pumping new fuel from the tank into the reservoir, and a control which effects a recirculation mode of secondary pump operation when the new fuel level in the fuel tank is above a predetermined low level and a scavenge mode of secondary pump operation when the new fuel level in the reservoir is below the predetermined low level. In the recirculation mode, the secondary pump recirculates reservoir fuel to avoid overflowing hot fuel into the fuel tank. In the scavenge mode, the secondary pump continuously maintains a partial vacuum in a screen in the fuel tank regardless of the fuel level in the reservoir to maximize new fuel scavenged from the fuel tank before fuel starvation occurs.

6 Claims, 2 Drawing Sheets

MODULAR FUEL SENDER FOR MOTOR VEHICLE

FIELD OF THE INVENTION

This invention relates to motor vehicle fuel systems of the type having a modular fuel sender in a fuel tank of the vehicle.

BACKGROUND OF THE INVENTION

U.S. Pat. No. 5,070,849, issued Dec. 10, 1991 and assigned to the assignee of this invention, describes a modular fuel sender for a motor vehicle including an in-tank reservoir which captures hot return fuel from an engine of the vehicle. A fuel pump in the reservoir pumps fuel to the engine and a secondary pump pumps new fuel from the tank into the reservoir. A float valve opens a recirculation flow path from the reservoir to the inlet of the secondary pump when the reservoir is full. In that circumstance, the secondary pump recirculates reservoir fuel in preference to new fuel from the fuel tank thereby to prevent overflow of hot return fuel from the reservoir. A modular fuel sender according to this invention has advantageous low-fuel performance characteristics not attainable with the modular fuel sender described in the aforesaid U.S. Pat. No. 5,070,849.

SUMMARY OF THE INVENTION

This invention is a new and improved motor vehicle modular fuel sender including an in-tank reservoir, an electric fuel pump in the reservoir for pumping fuel to an engine, and a secondary pump for pumping new fuel from the fuel tank into the reservoir. A new fuel flow path to the secondary pump includes a screen outside the reservoir, an intermediate chamber inside the reservoir, and a check valve between the screen and intermediate chamber. A float valve is disposed in a recirculation flow path between the reservoir and the intermediate chamber and includes a float valve element which seats by gravity against a valve seat when reservoir fuel level is below the valve seat and which is normally unseated by buoyancy when reservoir fuel level is above the valve seat. When the float valve element is unseated, the secondary pump recirculates reservoir fuel in preference to new fuel from the fuel tank. When the fuel tank is almost exhausted of new fuel, the secondary pump has a scavenge mode characterized by vacuum retention of the float valve element on the valve seat regardless of the fuel level in the reservoir. The scavenge mode has been observed to effect maximum scavenging of new fuel from the fuel tank to maximize the ultimate range a vehicle may be driven before fuel starvation occurs.

DESCRIPTION OF PREFERRED EMBODIMENTS

Figure 1:
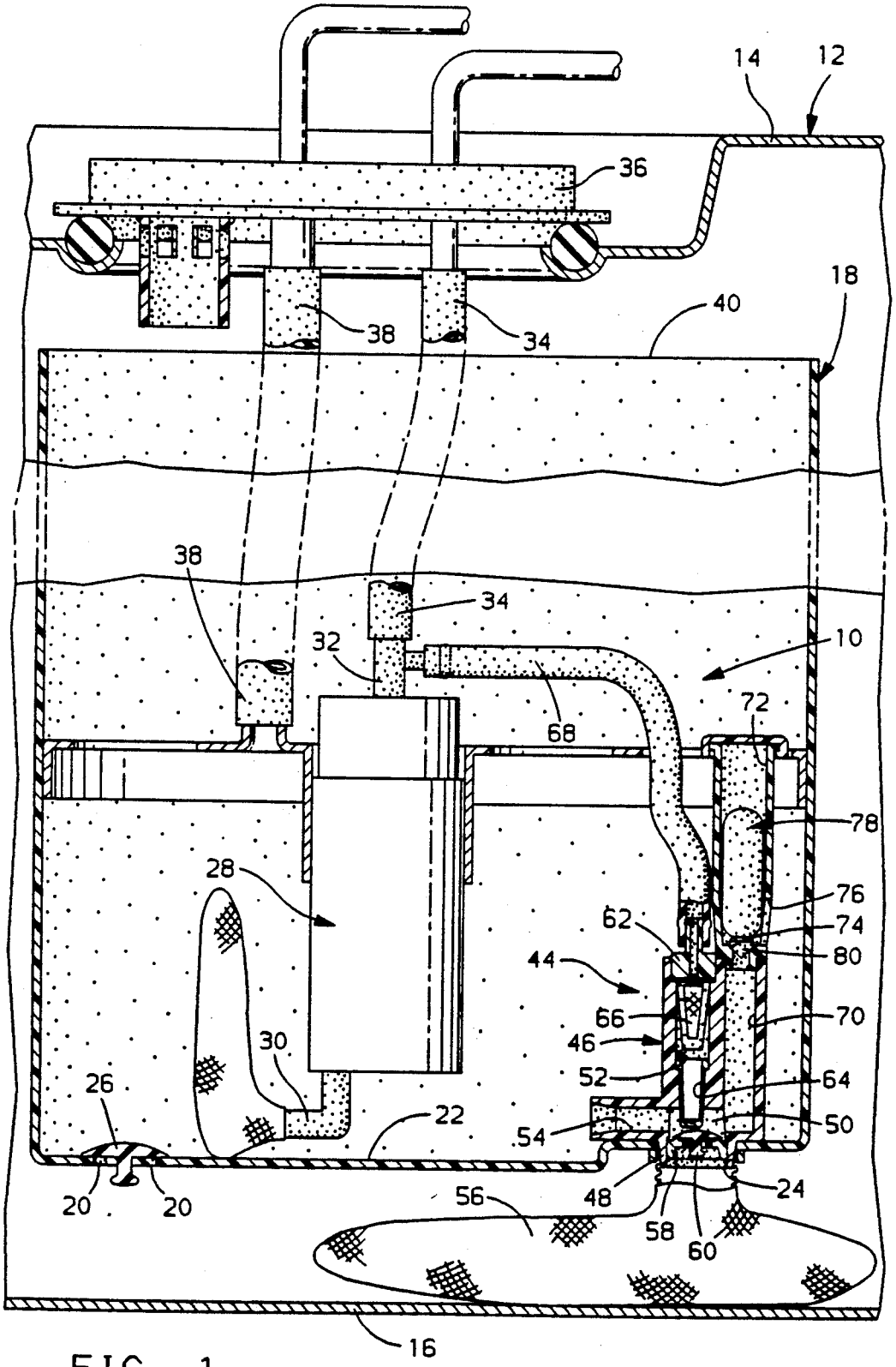
FIG. 1 is a schematic elevational view, partly in section, of a modular fuel sender according to this invention.

Referring to FIG. 1, a modular fuel sender 10 according to this invention is disposed in a fragmentarily illustrated fuel tank 12 of a motor vehicle, not shown. The fuel tank has an upper wall 14 and a lower wall 16. A reservoir 18 of the fuel sender in the fuel tank has a gravity fed new fuel inlet 20 in a bottom 22 of the reservoir and a mounting hole 24 in the bottom. A first rubber umbrella valve 26 permits gravity induced inflow through the new fuel inlet from the tank into the reservoir and blocks flow in the opposite direction.

The modular fuel sender 10 further includes an electric fuel pump 28 in the reservoir 18 having a screened or filtered inlet 30 in the reservoir and an a high pressure discharge 32. A representative electric fuel pump 28 is described in U.S. Pat. No. 4,718,827, issued Jan. 12, 1988 and assigned to the assignee of this invention. A wiring harness, not shown, synchronizes operation of the fuel pump with the operational state of the ignition of the motor vehicle.

A high pressure hose 34 connected to the fuel pump discharge 32 conducts high pressure fuel to an engine, not shown, of the motor vehicle through a cover 36 on the upper wall 14 of the fuel tank. A low pressure hose 38 conducts return or overage fuel from the engine to the reservoir. Return fuel is usually hot due to circulation through hot zones of the engine compartment of the vehicle.

The reservoir 18 is generally bucket-shaped and open at a top end 40 thereof which defines an overflow fuel level in the reservoir. The top end 40 is above the highest level of new fuel in the tank so that there is little or no in-and-out flow over the top. The top end may be partially closed to minimize splash-over while still venting the interior of the reservoir.

A secondary pump 44 in the reservoir pumps new fuel from the tank into the reservoir. In a preferred embodiment illustrated in FIG. 1, the secondary pump is a jet pump having a plastic housing 46 spin welded or otherwise rigidly attached to the bottom 22 of the reservoir with an annular flange 48 in the mounting hole 24. The housing 46 has an intermediate chamber 50 immediately above the mounting hole, a vertical passage 52 intersecting the intermediate chamber, and a horizontal venturi-shaped passage 54 also intersecting the intermediate chamber.

An outside screen 56 of the modular fuel sender 10 is attached to the annular flange 48 of the jet pump housing 46. In conventional fashion, the screen 56 is permeable to liquid fuel in the tank but impermeable to vapor so that a vacuum is maintained in the screen when new fuel in the fuel tank is near exhaustion and the screen 56 is partially submerged in liquid fuel and partially exposed to vapor. A material identified as Polyvinylidene Chloride (PVdC), manufactured by Lumite and available under the trade name Saran may be used for the screen.

A plastic check valve plate 58 is spin welded to the jet pump housing 46 inside the flange 48 thereof and separates the intermediate chamber 50 from the screen 56. The check valve plate 58 is perforated and supports a second flexible umbrella element 60 in the intermediate chamber 50 which normally covers the perforations to block backflow from the intermediate chamber into the screen. The second umbrella element is easily deflected to uncover the perforations in the valve plate by a modest pressure gradient between the intermediate chamber 50 and the screen 56 in the inflow direction.

A fluid connector 62 closes the open end of the vertical passage 52 in the jet pump housing. A cup-shaped nozzle 64 in the vertical passage 52 projects into the intermediate chamber 50 and has an orifice, not shown, aligned with an inboard end of the venturi-shaped horizontal passage 54. A filter 66 is disposed between the fluid connector 62 and the nozzle 64. A jet pump hose 68 extends between the high pressure discharge 32 of the fuel pump and the fluid connector 62 and diverts a fraction of the discharge of the fuel pump 28 to the nozzle 64 of the jet pump.

When the fuel pump 28 is on, a high pressure fuel jet issues from the orifice in the nozzle 64 into the horizontal passage 54. In conventional jet pump fashion, the high pressure jet entrains fuel from the intermediate chamber 50 and discharges the same from the horizontal passage into the reservoir. Withdrawal of fuel from the intermediate chamber induces a partial vacuum in the latter which, in turn, induces inflow of new fuel from the fuel tank through the screen 56 and the perforations in the valve plate 58.

The discharge rate of the secondary pump 44 is relatively constant and calculated to maintain the screened inlet 30 of the fuel pump at least partially submerged in fuel. In circumstances such as when the engine is idling, return flow through the low pressure hose 38 is high and may combine with the discharge of the secondary pump to raise the fuel level in the reservoir above the overflow level defined by the top 40 of the reservoir 18.

The jet pump housing 46 has a second internal vertical passage 70 intersecting the intermediate chamber 50. A hollow plastic float chamber 72 is spin welded to the jet pump housing over the second vertical passage. The float chamber has a circular valve seat 74 at an elevation below the top 40 of the reservoir 18. The float chamber 72 is open to the reservoir 18 through at least a plurality of side ports 76 just above the circular valve seat 74.

A hollow plastic float 78 is captured in the float chamber 72 and terminates at a conical valve element 80 facing the valve seat 74. The valve element has a bouyancy-induced unseated position, not shown, remote from the valve seat 74 when the fuel level in the reservoir is about above the valve seat and a gravity-induced seated position on the valve seat when the fuel level in the reservoir is about below the valve seat. In the unseated position of the valve element, a recirculation flow path is open from the reservoir to the intermediate chamber 50 through the side ports 76 and the second vertical passage 70. In the seated position of the valve element, FIG. 1, the aforesaid recirculation flow path is blocked.

Tests have demonstrated that the buoyancy of the float 78 may be coordinated with the performance characteristics of the jet pump 44 to achieve, in addition to the usual recirculation mode, a new and advantageous scavenge mode of secondary pump operation when new fuel in the fuel tank is near exhaustion. For example, the normal recirculation mode is observed when the level in the fuel tank is above about several inches from the lower wall 16 of the fuel tank. In that circumstance, corresponding to usually at least about 4 gallons of fuel in the tank, gravity and buoyancy shift the valve element 80 between its seated and unseated positions in accordance with the level of fuel in the reservoir to block and unblock the recirculation flow path as conditions warrant so that overflow of hot fuel from the reservoir is avoided.

The aforesaid scavenge mode of secondary pump operation is observed when the level of new fuel in the fuel tank 12 is below about 1 inch from the lower wall 16. In that circumstance, when the fuel level in the reservoir goes below about the elevation of the valve seat 74, gravity locates the float valve element 80 in its seated position as usual, blocking the recirculation flow path so that the jet pump pumps new fuel from the tank into the reservoir. As fuel level in the reservoir rises, however, partial vacuum in the intermediate chamber 50 retains the float valve element 80 in its seated position even as the reservoir fills to above the elevation at which buoyancy would normally induce movement of the float valve element to its unseated position. Accordingly, in the scavenge mode, the secondary pump 44 continues to induce partial vacuum in the intermediate chamber regardless of the fuel level in the reservoir and may even overflow the reservoir.

The aforesaid scavenge mode of secondary pump operation improves the low fuel handling capability of the modular fuel sender by maximizing the amount of new fuel which may be scavenged from the fuel tank 12 and, therefore, the range of the motor vehicle before fuel starvation occurs. For example, under very low new fuel conditions, inertia frequently causes new fuel to pool at the corners of the fuel tank away from the outside screen 56 and to slosh across the screen 56 as it flows back and forth between the corners during road maneuvers of the vehicle. With the secondary pump operating in its scavenge mode, partial vacuum is maintained in the intermediate chamber 50 and in the screen 56 so that each time the screen comes in contact with fuel sloshing back and forth across the lower wall 16 of the fuel tank, a fraction of the remainder is immediately drawn into the intermediate chamber 50 and pumped by the secondary pump into the reservoir. This little-by-little removal of the remaining new fuel in the tank continues until new fuel is virtually completely scavenged.

With heretofore known modular fuel senders wherein the secondary pump has only a recirculation mode, it has been observed that not as much new fuel is scavenged from the fuel tank before fuel starvation occurs. Therefore, a vehicle equipped with the modular fuel sender 10 according to this invention will have a greater range than vehicles equipped with the aforesaid prior modular fuel sender.

During a portion of the time the secondary pump 44 operates in its scavenge mode, the combination of new fuel from the fuel tank and return from the engine may overflow the reservoir. Such overflow is not objectionable, however, because by the time new fuel in the tank is almost exhausted it is "weathered" to a degree that its volatility and vapor generating characteristics are acceptable regardless of temperature.

Figure 2:
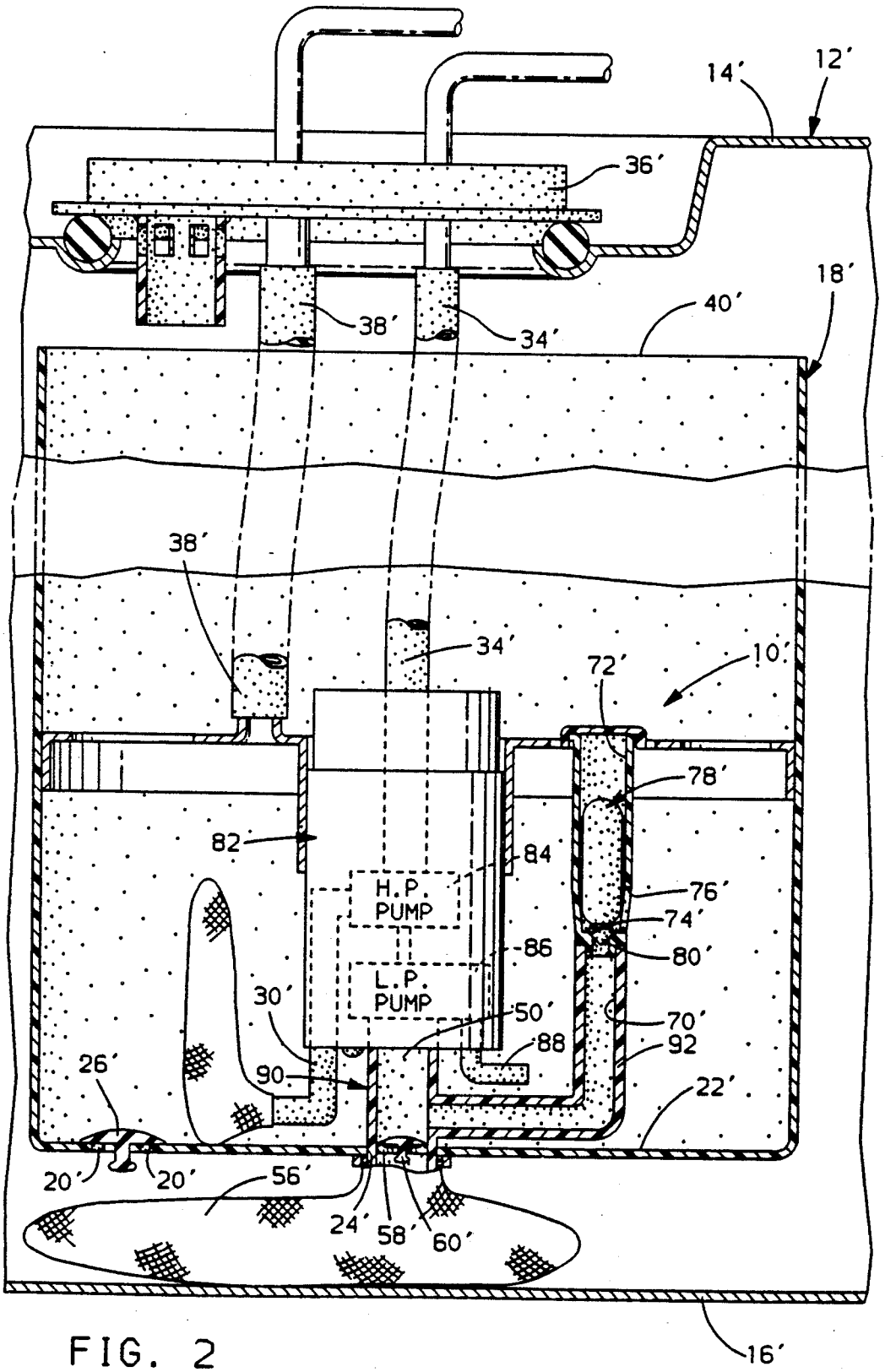
FIG. 2 is similar to FIG. 1 but showing a modified modular fuel sender according to this invention.

A modified fuel sender 10' according to this invention is illustrated in FIG. 2. For simplicity, elements common to both modular fuel senders 10,10' are identified by primed reference characters in FIG. 2. The fuel sender 10' is disposed in a fragmentarily illustrated fuel tank 12' having an upper wall 14' and a lower wall 16'. The fuel sender 10' includes a reservoir 18' in the fuel tank 12' having a gravity fed new fuel inlet 20' in a bottom 22' of the reservoir and a main inlet hole 24' in the bottom. A rubber umbrella valve 26' permits gravity induced inflow through the new fuel inlet from the tank into the reservoir and blocks flow in the opposite direction.

A low pressure hose 38' connected to the reservoir 18' through a cover 36' on the upper wall 14' conducts return fuel or overage from an engine, not shown, to the reservoir 18'. The reservoir 18' is generally bucket-shaped and open at a top 40' thereof which defines an overflow fuel level in the reservoir. The top 40' is above the highest level of new fuel in the tank so that there is little or no in-and-out flow over the top. The top may be partially closed to minimize splash-over while still venting the interior of the reservoir.

A pump assembly 82 in the reservoir 18' includes an electric motor, not shown, a schematically represented high pressure fuel pump 84, and a similarly schematically represented low pressure mechanical secondary pump 86. A representative pump assembly 82 is described in U.S. Pat. No. 5,129,796, issued Jul. 14, 1992 and assigned to the assignee of this invention.

The high pressure pump 84 has a screened inlet 30' in the reservoir 18'. A high pressure hose 34' connected to the high pressure pump 84 conducts fuel to an engine through the cover 36'. The secondary pump 86 has a discharge 88 in the reservoir 18'.

A suction pipe 90 connected to the inlet of the secondary pump 86 extends in sealed fashion through the main inlet hole 24' in the bottom 22' of the reservoir. An outside screen 56' covers the end of the suction pipe 90 outside of reservoir 18'. A perforated valve plate 58' in the suction pipe generally in the plane of the bottom of the reservoir supports a second umbrella valve element 60' which normally covers the perforations in the plate. The portion of the suction pipe 90 between the valve plate 58' and the inlet of the secondary pump 86 defines an intermediate chamber 50' in the reservoir. The second umbrella valve element 60' prevents backflow from the intermediate chamber into the screen.

An integral extension 92 of the suction pipe 90 defines a vertical passage 70 in fluid communication with the recirculation chamber 50'. A hollow plastic float chamber 72' is spin welded to the upper end of the extension 92 over the vertical passage 70'. The float chamber has a circular valve seat 74' at an elevation below the top 40' of the reservoir 18'. The float chamber 72' is open to the reservoir 18' through at least a plurality of side ports 76' just above the circular valve seat 74'.

A hollow plastic float 78' is captured in the float chamber 72' and terminates at a conical valve element 80' facing the valve seat 74'. The valve element has a bouyancy-induced unseated position, not shown, remote from the valve seat 74' when the fuel level in the reservoir is about above the valve seat and a gravity-induced seated position, FIG. 2, on the valve seat when the fuel level in the reservoir is about below the valve seat. In the unseated position of the valve element, a recirculation flow path is open from the reservoir to the intermediate chamber 50' through the side ports 76' and the vertical passage 70'. In the seated position of the valve element, FIG. 2, the aforesaid recirculation flow path is blocked.

The buoyancy of the float 78' may be coordinated with the performance characteristics of the secondary pump 86 to achieve, in addition to the usual recirculation mode, the aforesaid scavenge mode of secondary pump operation when new fuel in the fuel tank is near exhaustion. For example, the normal recirculation mode is observed when the level in the fuel tank is above about several inches from the bottom wall of the fuel tank. In that circumstance, corresponding to usually at least about 4 gallons of fuel in the tank, gravity and buoyancy shift the valve element 80' between its seated and unseated positions in accordance with the level of fuel in the reservoir to block and unblock the recirculation flow path as conditions warrant so that overflow of hot fuel from the reservoir is avoided.

The aforesaid scavenge mode of secondary pump operation is observed when the level of new fuel in the fuel tank 12' is below about 2 inches from the bottom wall 16'. In that circumstance, when the fuel level in the reservoir goes below about the elevation o of the valve seat 74', gravity locates the float valve element 80' in its seated position as usual, blocking the recirculation flow path so that the secondary pump 86 pumps new fuel from the tank into the reservoir. As fuel level in the reservoir rises, however, partial vacuum in the intermediate chamber 50' retains the float valve element 80' in its seated position even as the reservoir fills to above the elevation at which buoyancy would normally induce movement of the float valve element to its unseated position. Accordingly, in the scavenge mode, the secondary pump 86 continues to induce partial vacuum in the intermediate chamber regardless of the fuel level in the reservoir to the end that maximum new fuel is scavenged from the fuel tank as described above.

The embodiments of the invention in which an exclusive property or privilege is claimed are defined as follows:

1. A modular fuel sender disposed in a fuel tank of a motor vehicle comprising:

a reservoir in said fuel tank having a top defining an overflow fuel level of said reservoir, a high pressure pump having an inlet in said reservoir and a discharge connected to an engine of said vehicle, a low pressure conduit means conducting return fuel from said engine to said reservoir, a secondary pump having a discharge in said reservoir and an inlet, means defining a recirculation flow path between said reservoir and said secondary pump inlet, means defining a new fuel flow path from said fuel tank to said secondary pump inlet, and control means connected to said recirculation flow path and to said new fuel flow path responsive to a reservoir fuel level and to a fuel tank new fuel level to effect a recirculation mode of secondary pump operation wherein said recirculation flow path is blocked and unblocked to maintain said reservoir fuel level below said overflow level when said fuel tank new fuel level is above a predetermined low level and to effect a scavenge mode of secondary pump operation wherein said recirculation flow path is continuously blocked when said reservoir fuel level is above and below said overflow fuel level when said fuel tank new fuel level is below said predetermined low level to thereby maximize scavenging of new fuel from said fuel tank.

2. The modular fuel sender recited in claim 1 wherein said control means includes:

means defining an intermediate chamber, means connecting said intermediate chamber to each of said recirculation flow path and said new fuel inlet flow path such that said secondary pump induces a partial vacuum in said intermediate chamber when said secondary pump is on, means defining a valve seat in said recirculation flow path below said overflow fuel level in said reservoir, means defining a float chamber above said valve seat exposed to said reservoir, a float in said float chamber, and means on said float defining a float valve element having a gravity induced seated position on said valve seat blocking said recirculation flow path and a buoyancy-induced unseated position remote from said valve seat unblocking said recirculation flow path in accordance with said reservoir fuel level and being maintained in said seated position regardless of said reservoir fuel level by said partial vacuum in said intermediate chamber when said fuel tank new fuel level is below said predetermined low level.

3. The modular fuel sender recited in claim 2 wherein said means connecting said intermediate chamber to each of said recirculation flow path and said new fuel inlet flow path includes, a screen in said fuel tank outside said reservoir made of a material permeable to liquid flow therethrough and impermeable to vapor flow therethrough, means connecting said screen to said intermediate chamber, and means defining a one-way valve between said screen and said intermediate chamber permitting inflow to said intermediate chamber and blocking flow in the opposite direction.

4. The modular fuel sender recited in claim 3 wherein said means defining a one-way valve between said screen and said intermediate chamber includes:

a plate member having a plurality of perforations therein, and an umbrella valve element supported on said plate member covering said perforations therein and flexible under a pressure gradient in the direction of flow into said intermediate chamber to uncover said perforations to permit inflow into said intermediate chamber.

5. The modular fuel sender recited in claim 4 wherein:

said secondary pump is a jet pump.

6. The modular fuel sender recited in claim 4 wherein:

said secondary pump is a mechanical pump.

* * * * *